US007061460B2

(12) United States Patent
Shimizu

(10) Patent No.: US 7,061,460 B2
(45) Date of Patent: Jun. 13, 2006

(54) METHOD OF DRIVING LIQUID-CRYSTAL DISPLAY

(75) Inventor: Shigeo Shimizu, Yokohama (JP)

(73) Assignee: Victor Company of Japan, Ltd. (JP)

( * ) Notice: Subject to any disclaimer, the term of this patent is extended or adjusted under 35 U.S.C. 154(b) by 384 days.

(21) Appl. No.: 10/631,701

(22) Filed: Jul. 31, 2003

(65) Prior Publication Data

US 2004/0021626 A1 Feb. 5, 2004

(30) Foreign Application Priority Data

Aug. 1, 2002 (JP) ..... 2002-225259

(51) Int. Cl.
*G09G 3/36* (2006.01)

(52) U.S. Cl. ..... 345/94; 345/89; 345/204; 345/208; 345/213

(58) Field of Classification Search ..... 345/94, 345/87, 89, 204, 208–209, 213
See application file for complete search history.

(56) References Cited

U.S. PATENT DOCUMENTS 6,304,239 B1 * 10/2001 McKnight ..... 345/87
6,570,550 B1 * 5/2003 Handschy et al. ..... 345/89

FOREIGN PATENT DOCUMENTS

| | | |
|---|---|---|
| JP | 06(1994)-138434 | 5/1994 |
| JP | 11(1999)-174410 | 7/1999 |
| JP | 2001-166749 | 6/2001 |
| JP | 2001-290174 | 10/2001 |

* cited by examiner

*Primary Examiner*—Bipin Shalwala
*Assistant Examiner*—Leonid Shapiro
(74) *Attorney, Agent, or Firm*—Renner, Kenner, Greive, Bobak, Taylor & Weber

(57) ABSTRACT

A liquid-crystal display is driven by pulse-width modulation. One frame of an input video signal is divided into a plurality of subframes. A first pulse signal is applied to a liquid crystal irrespective of the level of the input video signal. A pulse width of the first pulse signal corresponds to the duration of the subframe. Application of the first pulse signal only does not drive the liquid crystal. A second pulse signal is applied to the liquid crystal in accordance with the level of the input video signal so that second pulses of the second pulse signal are superimposed on the first pulses at the same polarity, to perform pulse-width modulation to the liquid crystal. An average duration P of the subframes and a response time L obtained by adding a rise time and a fall time of the liquid crystal meet the requirements P<L and P≦0.15×L.

3 Claims, 9 Drawing Sheets

METHOD OF DRIVING LIQUID-CRYSTAL DISPLAY

BACKGROUND OF THE INVENTION

The present invention relates to a method of driving a liquid-crystal display mounted on projection displays, view finders, head-mount displays, etc.

Active-matrix displays are usually driven by an analog signal that controls a drive voltage for liquid crystals, such as, disclosed in Japanese Unexamined Patent Publication No. 11-174410 (1999).

There are several modes for liquid crystals:

1. Polarization Mode

Ferroelectric Liquid Crystal (FLC);

Vertical Aligned (VA);

Hybrid Aligned Nematic (HAN);

Twisted Nematic (TN);

Electrically Controlled Birefringence (ECB);

Mixed-mode Twisted Nematic (MTN);

Self-Compensated Twisted Nematic (SCTN);

Reflected Twisted Nematic (RTN); and

Hybrid Field-Effect (HFE)

2. Dispersion Mode

Polymer Dispersed Liquid Crystal (PDLC)

3. Diffraction Mode

Zero Field Diffraction (ZFD)

Liquid crystals used in high picture-qualify systems are VA, MTN, etc. Particularly, VA is used for obtaining high contrast ratio.

Active-matrix displays have multiple pixels formed with a liquid crystal filled between an active-matrix substrate and another substrate. A signal supplied to each pixel is stored in a storage capacitor provided for the pixel, to drive the liquid crystal.

FIG. 1 shows a schematic block diagram of a typical active-matrix display driven by an analog signal.

In FIG. 1, column-signal electrodes D1, D2, D3, . . . , and Di are aligned on an active-matrix substrate 2. Also aligned on the substrate 2 are row-scanning electrodes G1, G2, G3, . . . , and Gj, intersecting with the column-signal electrodes.

Provided at the intersection of each column-signal electrodeD (D1, D2, D3, . . . , and Di) and each row-scanning electrode G (G1, G2, G3, . . . , and Gj) is a pixel Px having a pixel-switching transistor Tr, a storage capacitor Cs, and a liquid crystal LC, as shown in FIG. 2.

A column-signal-electrode driver 100 is equipped with a horizontal shift register 101 and several analog switches S1, S2, S3, . . . , and Si.

Input terminals of the analog switches S1, S2, S3, and Si are connected to a display-signal supply line L through which a display signal VIDEO is supplied. Output terminals of the switches S1, S2, S3, . . . , and Si are connected to the column-signal electrodes D1, D2, D3, . . . , and Di, respectively. A control terminal of each switch S is connected to the corresponding output of the horizontal shift register 101.

The horizontal shift register 101 is driven by a horizontal start signal HST and a horizontal clock signal HCK, to output pulses. The signals HST and HCK are supplied from a drive timing pulse generator (not shown).

The pulses output from the are horizontal shift register 101 are supplied to the analog switches S1, S2, S3, . . . , and Si, to sequentially turn on these switches. The turn-on switches allow the display signal VIDEO for one horizontal period to be sequentially supplied to the column-signal electrodes D1, D2, D3, . . . , and Di.

A row-scanning-electrode driver 102 is equipped with a vertical shift register having several register stages corresponding to the number of rows to be displayed.

The vertical shift register is driven by a vertical start signal VST and a vertical shift clock signal VCK synchronizing with one horizontal period, to output scanning pulses. The signals VST and VCK are supplied from a drive timing pulse generator (not shown).

The scanning pulses output from the vertical shift register are sequentially supplied to the row-scanning electrodes G1, G2, G3, . . . , and Gj per horizontal period (per row).

A vertical period of the display signal VIDEO is synchronized with the vertical start signal VST.

The scanning pulses turn on, sequentially per row, the pixel-switching transistors Tr connected to the row-scanning electrodes G1, G2, G3, . . . , and Gj.

Each turned-on pixel-switching transistor Tr in FIG. 2 allows the display signal VIDEO, supplied to the corresponding column-signal electrode D, to be stored as charge information in the storage capacitor Cs of the corresponding pixel Px.

The stored charge information is supplied to the liquid crystal LC via a display-pixel electrode 20 for light modulation. The light modulation provides images to be displayed corresponding to the display signal VIDEO.

This type of active-matrix display, however, has the following disadvantages.

In FIG. 2, the scanning pulse is supplied to the gate of the pixel-switching transistor Tr to turn on the transistor to store the charge information (display signal VIDEO) in the storage capacitor Cs.

At the moment of supplying the scanning pulse (gate voltage Vg) to the gate of the pixel-switching transistor Tr, a voltage (drain voltage Vd) appearing at the drain of the transistor Tr rapidly varies as shown in FIG. 3 (field-through voltage Vft) due to field through caused by a gate-to-drain floating capacitance CGD, with respect to a voltage Vf of an electrode 21 facing the display-pixel electrode 20 in FIG. 2.

Subsequent no supply of the scanning pulse to the gate of the pixel-switching transistor Tr varies the drain voltage and then keeps the varied drain voltage, as shown in FIG. 3.

The voltage varying as shown in FIG. 3 is then supplied to the liquid crystal LC, as D.C. (direct current) components, which causes low photo response and image persistence (or burn-in), etc, thus resulting in short life for the liquid-crystal panel.

In addition, this type of active-matrix display is prone to generation of noises on the display signal VIDEO and effects of pseudo display signals, although provides enhanced gradation with voltages supplied to the liquid crystal constant for one-field period but varying in accordance with the level of the display signal VIDEO.

A method of driving a liquid crystal with pulses is disclosed in Japanese Unexamined Patent Publication No. 2001-166749, to solve the problems discussed above.

In this method, pixels are turned on or off in accordance with the values of bits of gradation data indicating gradation on the pixels for a period corresponding to weighting to the bits in each of subfields of one field.

Pulse-width modulation is performed in accordance with the value of each bit of the gradation data for a bit-turn-on (-off) period in one field, thus controlling the root mean square value of a voltage supplied to the liquid crystal for gradation control.

Bit-turn-on (-off) signals in each subfield are bit data of low or high level, thus not requiring analog processing circuitry, such as, a D/A converter and an operational amplifier.

Therefore, images displayed in this method are free from problems caused by instability of circuit property and wiring resistance, etc., which may otherwise occur when analog processing circuitry is employed.

This method is advantageous in pixel turn-on (-off) control performed per subfield.

Nevertheless, on- (-off) control to a drive voltage that consists of one type of pulse to the liquid crystal could cause input/output gradation differences based on the liquid-crystal response characteristics.

In addition, this method is prone to change in drive characteristics among RGB liquid-crystal panels and also change in gamma characteristics due to change in liquid-crystal response characteristics caused by temperature change, thus disadvantageous in color reproduction.

Pulse-driven adjustments to the drive characteristics among RGB liquid-crystal panels is, for example, disclosed in Japanese Unexamined Patent Publication No. 6-138434 (1994).

A liquid-crystal projector disclosed here is equipped with liquid-crystal panels for R, G and B colors and a driver for controlling a pulse width of a drive pulse signal for driving each of the RGB liquid-crystal panels in accordance with input color signals to be displayed, for adjustments to the drive characteristics different among the R, G and B colors.

The drive-pulse width is varied per RGB liquid-crystal panel based on difference in intensity curves among the panels.

It is well known that chromaticity (x, y) from white to black (dark scale) is constant at (0. 3, 0. 3) while gradation is being varied from white to black with projection of colors with combination of light beams from three liquid-crystal panels, in full-color displaying.

Difference in RGB liquid-crystal panel characteristics could, however, cause displaying of yellow for bright white or purple for dark black.

The drive-characteristics adjustments disclosed in Japanese Unexamined Patent Publication No. 6-138434 (1994) Achieves enhanced gray scale with pulse-width adjustments to drive voltage per RGB panel to adjust drive characteristics.

This technique is advantageous to fewer pixels and also less gradation where as disadvantageous to high-density full-color displaying due to circuit complexity. It is also disadvantageous in easily causing variation in gradation, or difficulty in fine gradation adjustments due to non-linear liquid-crystal driving. Moreover, no anti-high-temperature response-speed measurements are disclosed for projectors that suffer from temperature rise.

Disclosed, for example, in Japanese Unexamined Patent Publication No. 2001-290174 is adjustments to drive parameters against change in liquid-crystal characteristics due to temperature change.

In detail, disclosed here is adjustments to input voltages in accordance with liquid-crystal characteristics per temperature (gamma correction) to achieve fined is playing against temperature change for high response-speed smectic liquid crystals suffering from change in voltage-to-transmissivity characteristics due to temperature change.

Gamma correction is achieved with reconversion of 8-bit digital signal to 8-bit digital signal, adjustments to digital-to-analog conversion characteristics to match voltage-to-transmissivity characteristics and conversion of 8-bit digital signal to 10-bit digital signal.

The technique disclosed in this publication is advantageous in accurate gamma correction with a digital gamma-correction circuit that digitally handles input digital data.

Nevertheless, the output of the digital gamma-correction circuit converted into an analog signal by D/A conversion is prone to noises in driving a liquid crystal.

Moreover, the technique disclosed in this publication requires high costs on temperature sensors attached to liquid-crystal cells for gamma correction. In addition, temperature distribution over the liquid-crystal cells causes difficulty in accurate gamma correction.

SUMMARY OF THE INVENTION

A purpose of the present invention is to provide a method of digitally driving a liquid-crystal display with high color reproducibility and fine gradation against temperature change.

The present invention provides a method of driving a liquid-crystal display comprising the steps of: driving one frame of an input signal into a plurality of subframe; applying a first pulse signal to a liquid crystal irrespective of a level of the input video signal, a pulse width of the first pulse signal corresponding to a duration of each subframe, application of the first pulse signal only not driving the liquid crystal; and applying a second pulse signal to the liquid crystal in accordance with the level of the input video signal so that second pulses of the second pulse signal are superimposed on the first pulses at the same polarity, to perform pulse-width modulation to the liquid crystal, wherein an average duration P of the subframes and a response time L obtained by adding a rise time and a fall time of the liquid crystal meet the following requirements: $P<L$ and $P \leqq 0.15 \times L$.

DETAILED DESCRIPTION OF PREFERRED EMBODIMENT

An embodiment according to the present invention will be disclosed with reference to the attached drawings.

Figure 1:
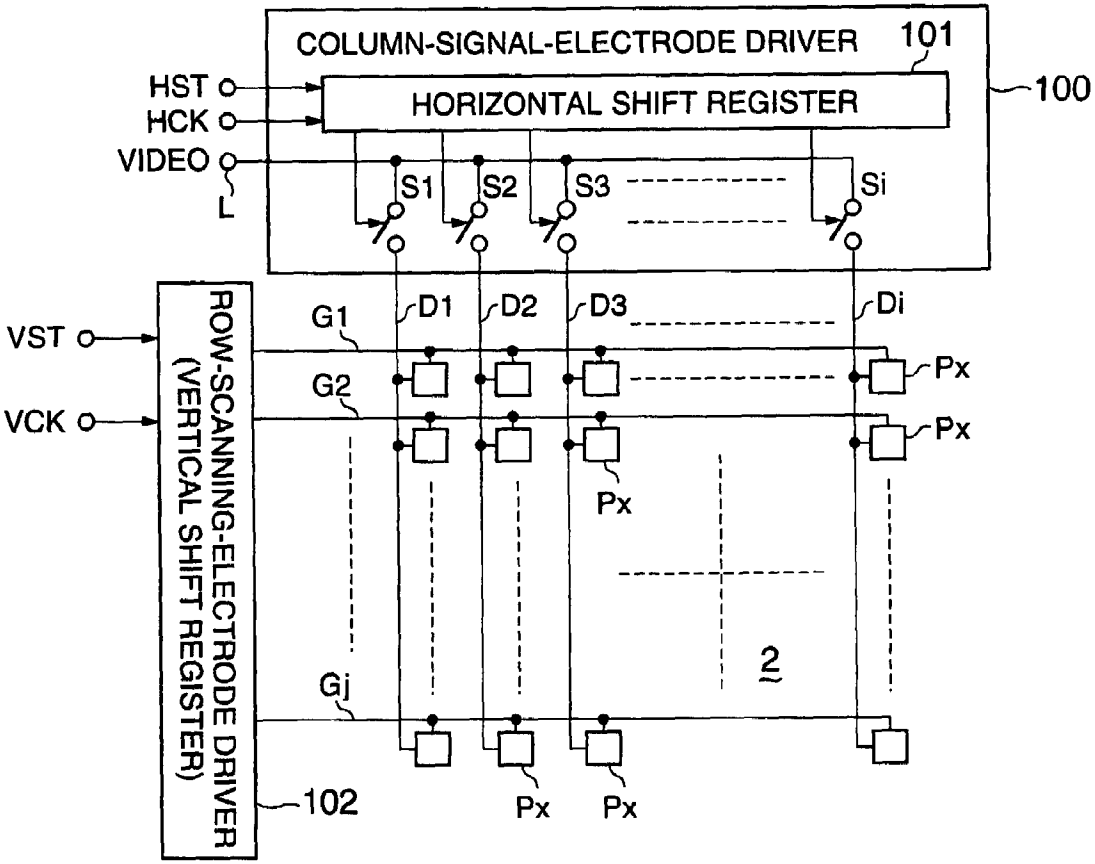
FIG. 1 (RELATED ART)
FIG. 1 shows a schematic block diagram of a typical active-matrix display driven by an analog signal.
Figure 2:
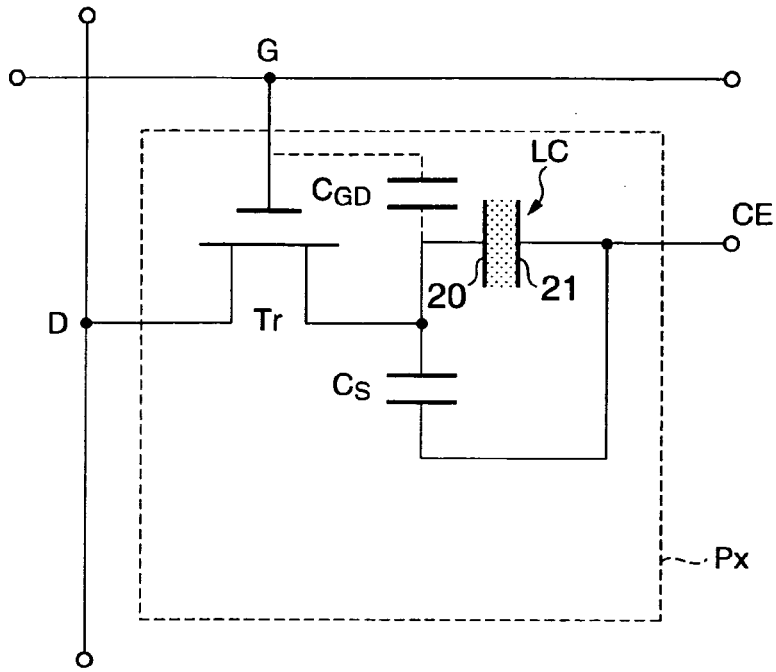
FIG. 2 shows a circuit provided for each pixel in the active-matrix display shown in FIG. 1.
Figure 3:
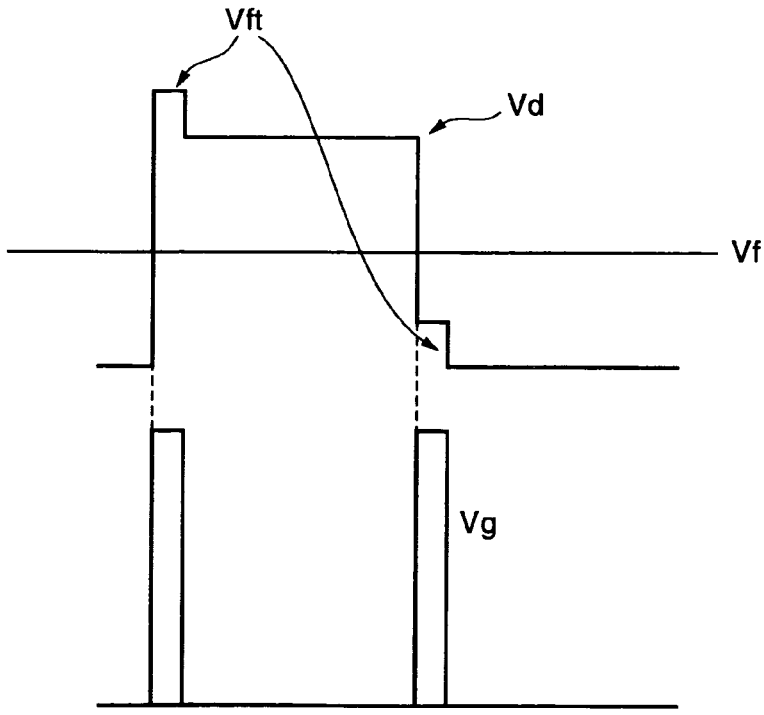
FIG. 3 illustrates a field-through voltage due to field through caused by a gate-to-drain floating capacitance.
Figure 4:
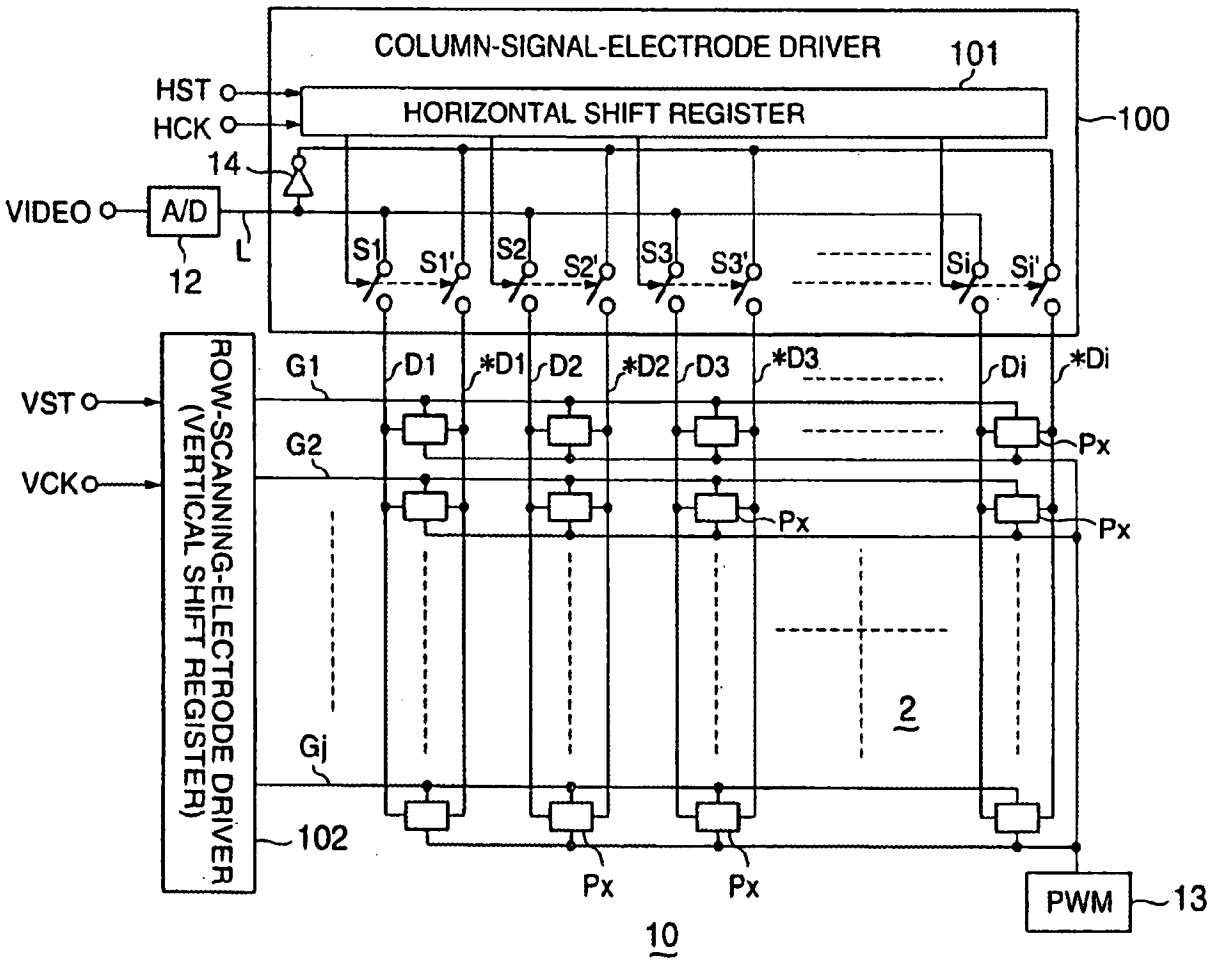
FIG. 4 shows a block diagram of a PWM-based liquid crystal display according to the preset invention.

FIG. 4 shows a PWM-based liquid crystal display according to the preset invention, elements thereof the same as or analogous to those shown in FIG. 1 being given the same reference numerals and signs, hence not disclosed in detail.

An input vide signal VIDEO is supplied to an A/D converter 12 to be converted into a digital signal. The digital signal is supplied to column-electrodes D1 to Di via analog switches S1 to Si, respectively.

Figure 5:
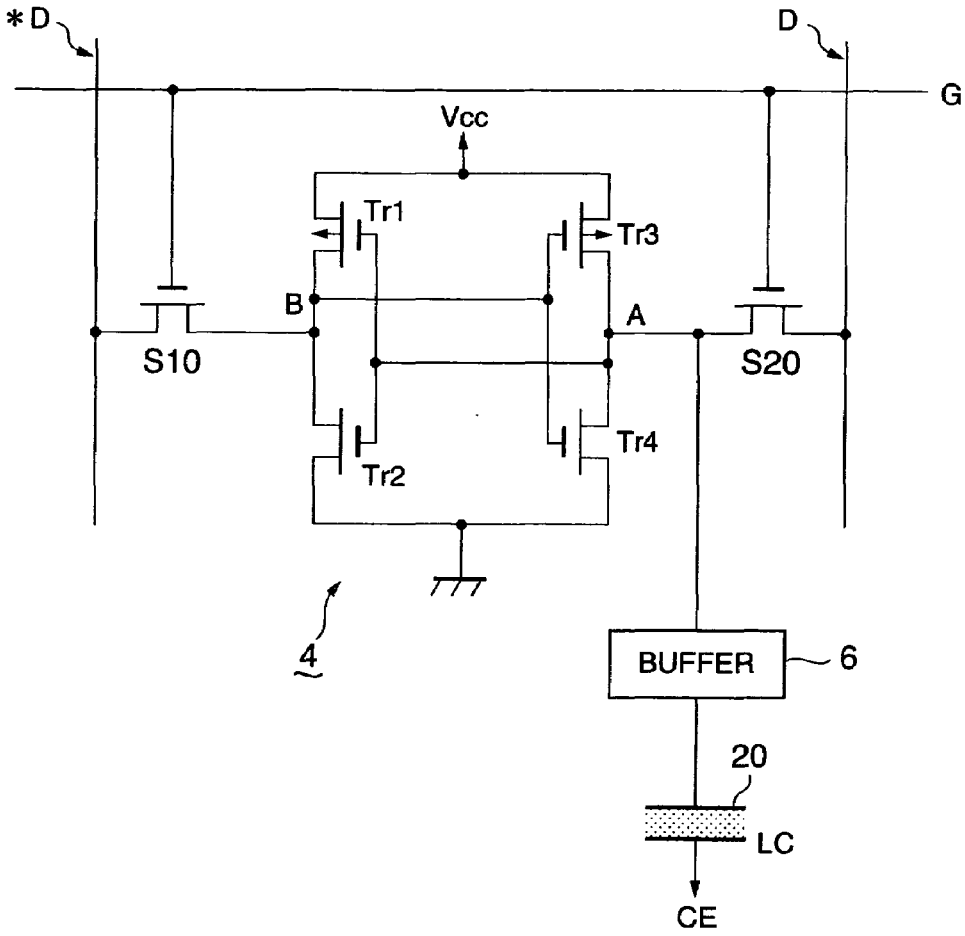
FIG. 5 shows a pulse driver provided for each pixel in the PWM-based liquid crystal display shown in FIG. 4.

The digital signal supplied to each of the column-electrodes D1 to Di is stored in an SRAM (static RAM) 4 for each pixel shown in FIG. 5 (a pulse driver).

A pulse-width modulator (PWM) 13 shown in FIG. 4 is connected to a buffer circuit 6 in FIG. 5. It sets a period of time for applying the signal stored in the SRAM 4 to a liquid crystal LC that is connected to a common electrode CE.

The digital vide signal VIDEO is further inverted by an inverter 14 and supplied to column-electrodes *D1 to *Di via switches S1' to Si', respectively. The switches are turned on or off in synchronism with the analog switches S1 to Si.

The pulse driver shown in FIG. 5 for PWM-based digital liquid-crystal driving withstands effects of floating capacity between the electrodes because of each fixed electrode potential, thus far less prone to several problems on displayed images compared to analog liquid-crystal driving.

The pulse driver shown in FIG. 5 is equipped with the SRAM 4 for storing the digital input video signal VIDEO and the buffer circuit 6 for transferring the stored signal to each pixel electrode 20.

The SRAM 4 has a flip-flop of transistors Tr1 to Tr4. It is connected to the column-signal electrode D for the stored video signal VIDEO and the other column-signal electrode *D for a video signal *VIDEO (the inversion of the stored signal VIDEO) via switching transistors S20 and S10, respectively.

The digital input video signal VIDEO is temporarily stored in the SRAM 4 when a pulse is supplied to the gates of the switching transistors S20 and S10 via the row-scanning electrode G, in synchronism with the video signals VIDEO and *VIDEO flowing through the column-signal electrodes D and *D, respectively.

An external signal supplied to the buffer circuit 6 turns on a switch (not shown) of the circuit 6 to allow the video signal VIDEO stored in the SRAM 4 to be supplied to the liquid crystal LC to drive liquid-crystal molecules.

Figure 6:
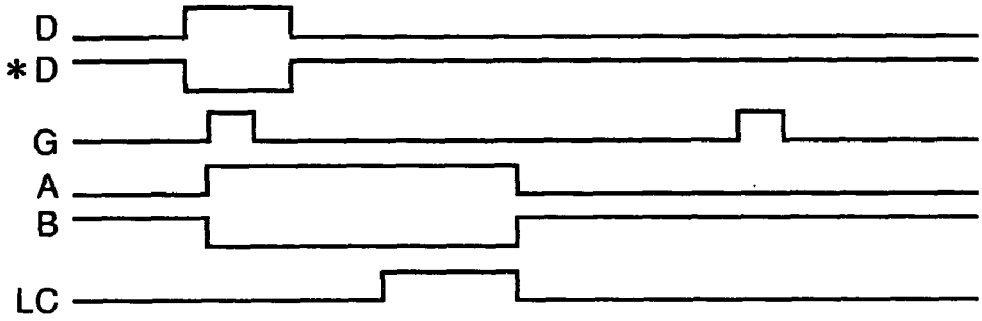
FIG. 6 shows timing charts indicating an operation of the circuit shown in FIG. 5.

In timing charts shown in FIG. 6 for the pulse driver in FIG. 5, waveforms A and B indicate potentials at nodes A and B, respectively, shown in FIG. 5.

The liquid crystal LC is a negative dielectric anisotropic liquid crystal exhibiting orientation almost perpendicular to an active-matrix substrate while no voltage is being applied.

Disclosed next in detail is a method of driving the liquid crystal display configured as above, according to the present invention.

The features of the driving method according to the present invention are as follows:

Generated first is a first pulse signal, pulses thereof being inverted in one frame divided into, for example, 22 subframes. Generated next is a second pulse signal, pulses thereof being superimposed on the pulses of the first pulse signal at the same polarity.

The first pulse signal is adjusted so that integration of the pulses is almost zero in one frame. The level of the first pulse signal is further adjusted so that application of this pulse signal only does not drive the liquid crystal.

Pulse-width modulation is performed when the second pulse signal is superimposed on the first pulse signal.

An average duration P of the subframes and a response time L (addition of a rise time and a fall time) of the liquid crystal meet the following requirements:

$$P<L \text{ and}$$

$$P<0.15\times L$$

Pulse-width modulation is performed at the PWM 13 as follows:

A general driving method with a first pulse signal and a second pulse signal superimposed thereon causes output-light stepped portions in input signal-to-output light characteristics.

To avoid such output-light stepped portions, in the present invention, the input video signal is supplied to the liquid crystal as a combination of the first pulse signal and the second pulse signal.

The first pulse signal is always applied to the liquid crystal irrespective of the level of the input video signal whereas the second pulse signal is applied to the liquid crystal in accordance with the level of the input video signal level.

Figure 7:
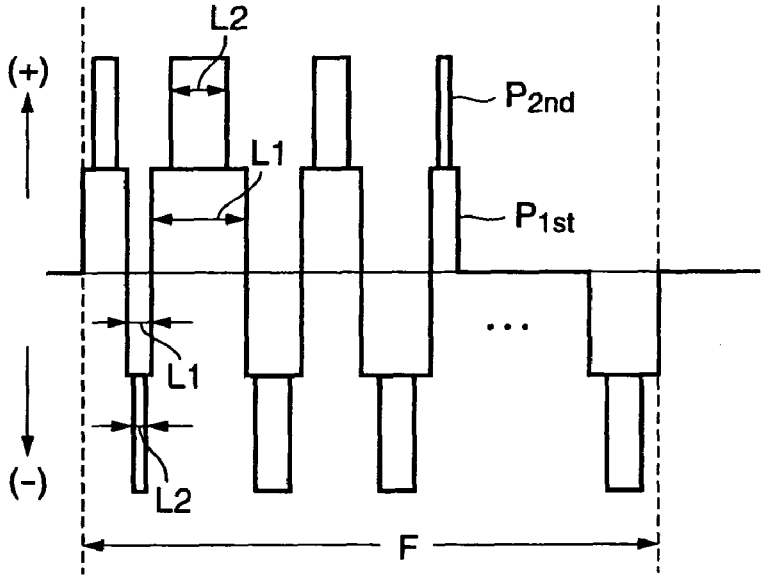
FIG. 7 illustrates exemplary pulse widths of a first and a second pulse signal.

The first and second pulse signals $P_{1st}$ and $P_{2nd}$ are illustrated in FIG. 7. A pulse width L1 of the first pulse signal corresponds to the length or duration of each subframe within one frame F. The second pulse signal has a pulse width L2.

Figure 8:
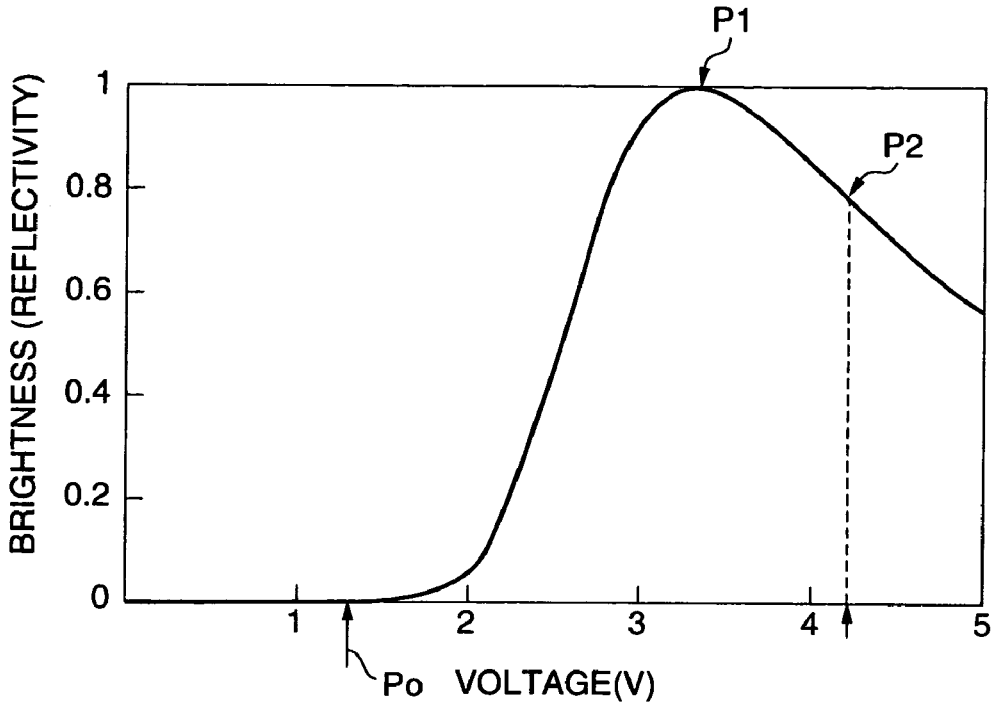
FIG. 8 shows a graph indicating brightness (reflectivity) to the root mean square value of pulse signals.

Shown in FIG. 8 is graph showing brightness (reflectivity) to the root mean square value of the pulse signals.

The amplitude of the first pulse signal is set at a threshold voltage P0 just before the liquid crystal is subjected to modulation. The amplitude of the second pulse signal is set at a voltage P2 passing a peak voltage P1 at which the liquid crystal produces the maximum brightness (reflectivity), or between the peak voltage P1 and the threshold voltage P0.

As shown in FIG. 7, the pulses of the first pulse signal $P_{1st}$ are being inverted in one frame and those of the second pulse signal $P_{2nd}$ is superimposed thereon at the same polarity.

The first pulse signal is adjusted so that integration of the pulses is almost zero in one frame. The level of the first pulse signal is further adjusted so that application of this pulse signal only does not drive the liquid crystal.

In other words, the second pulse signal is subjected to pulse-width modulation. In detail, pulse-width modulation is performed such that pulses of all subframes in one frame are set at a positive or a negative polarity in the maximum modulation, integration of the positive and negative pulses in one frame being zero, so as not to apply a D.C. voltage to the liquid crystal. The second pulse signal is inverted per frame.

The liquid crystal LC (FIG. 5) in this invention is a negative dielectric anisotropic liquid crystal exhibiting orientation almost perpendicular to an active-matrix substrate while no voltage is applied.

Using such type of liquid crystal in this invention offers a very clear black on screen while no voltage is applied (normally black). Pulse-width modulation (PWM 13 in FIG. 4) to such type of liquid crystal in this invention requires only a small driving voltage to the liquid crystal thanks to a quick rise time but a long fall time, which is not a D.C. voltage within one frame and also over frames, thus achieving highly reliable displaying of high quality images.

Figure 9:
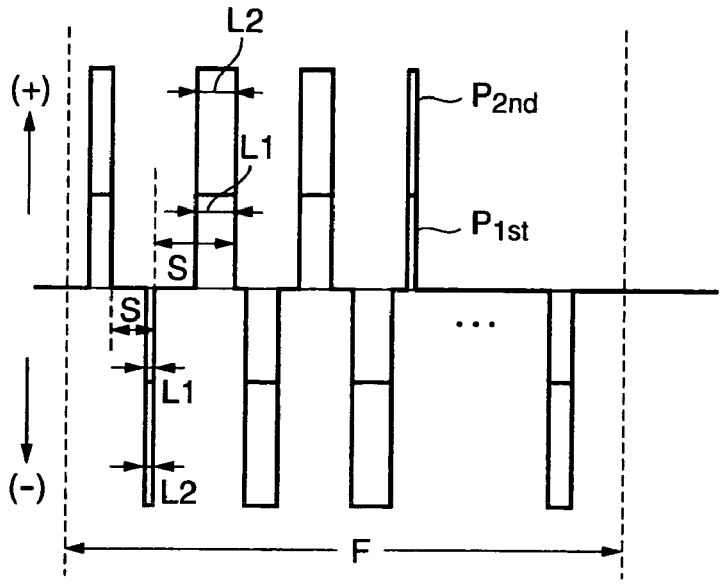
FIG. 9 illustrates other exemplary pulse widths of a first and a second pulse signal.

Illustrated in FIG. 9 is an alternative pulse wave forms for one frame F available in this invention. A first pulse signal $P_{1st}$ and a second pulse signal $P_{2nd}$ superimposed thereon have the same pulse width within a subfield S.

A ratio of the width of the second pulse signal to that of the first pulse signal is larger the better, close to 1, as much as possible, and preferable always constant.

Figure 10:
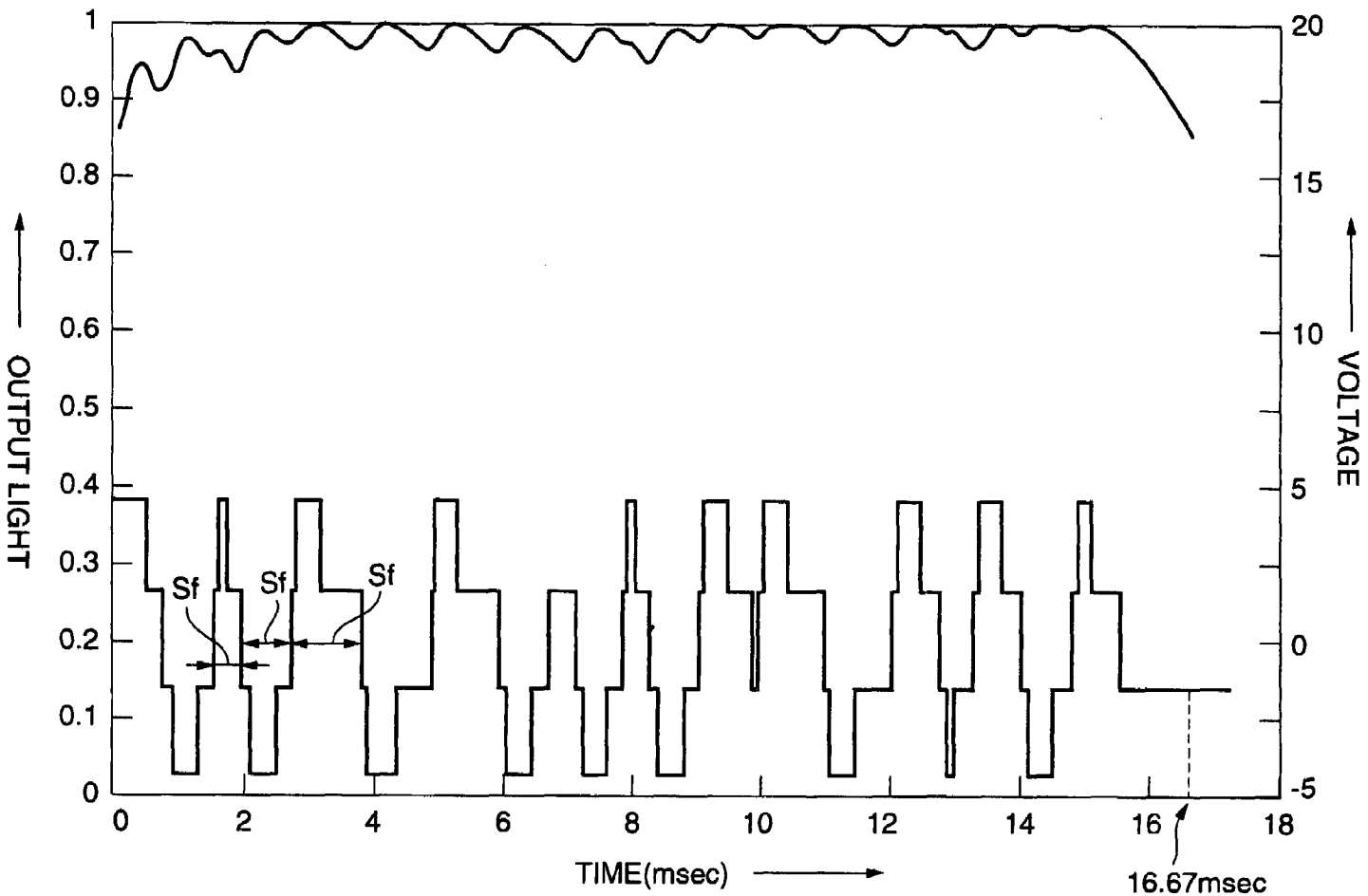
FIG. 10 shows a graph indicating change in output light to voltage of a pulse drive signal within one frame divided into 22 subframes.

Illustrated in FIG. 10 is graph indicating change in output light to voltage of a pulse drive signal within one frame divided into 22 subframes Sf.

The embodiment offers normally black on screen using a liquid crystal exhibiting orientation almost perpendicular to an active-matrix substrate while no voltage is applied, causing no twist to liquid-crystal molecules with almost no portions to loose brightness, thus achieving bright displaying.

In addition, the liquid crystal exhibits orientation almost perpendicular to an active-matrix substrate against a threshold voltage, thus offering a very clear black on screen, while no voltage is applied, for high contrast.

Moreover, pulse-width adjustments to each of the first and the second pulse signals achieves enhanced gradation with almost no step-like variation in output light which may otherwise occur in bit change.

As already disclosed, one feature of the present invention is that the average duration P of the subframes, which is an average pulse width of the first pulse signal, and the response time L (addition of a rise time and a fall time) of the liquid crystal meet the following requirements:

$$P<L \text{ and}$$

$$P<0.15\times L$$

The average duration P is an average of durations of subframes within one frame F, the duration L1 of each subframe (width of each pulse in the first pulse signal) being illustrated in FIG. 7.

Figure 11:
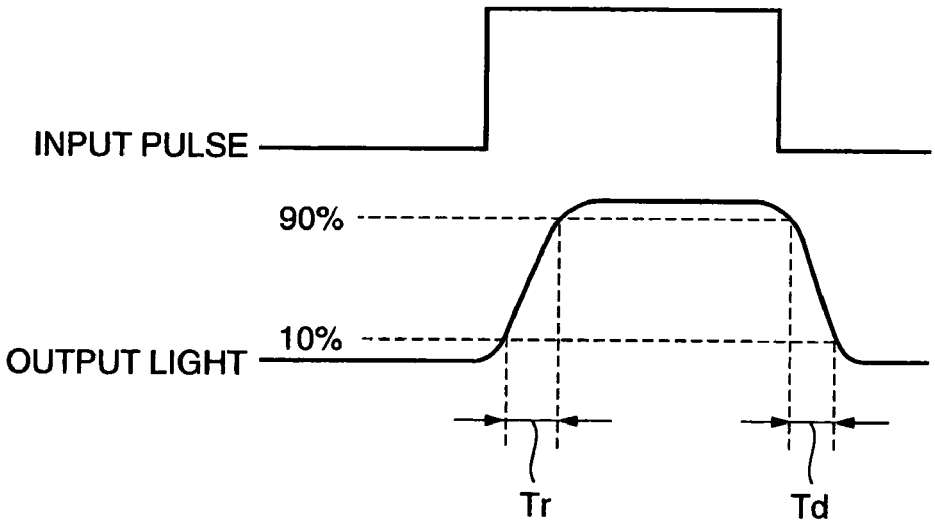
FIG. 11 illustrates a response speed of a liquid crystal.

Response speed of the liquid crystal LC is illustrated in FIG. 11 that shows an input pulse to the liquid crystal LC and output light therefrom.

A rise time Tr is a period for the output light from the liquid crystal LC increasing from 10% to 90% after the input pulse rises.

A fall time Td is a period for the output light from the liquid crystal LC decreasing from 90% to 10% after the input pulse falls.

The response time L discussed above is thus given by L=Tr+Td, which offers high color reproducibility with almost no effects of change in viscosity of the liquid crystal LC due to temperature change, etc.

The high color reproducibility in this invention will be discussed for 512 gradations (29) with a 9-bit video signal.

Nine-bit video signals basically require 9 subframes per frame, however, have 22 subfarames per frame, for example, as illustrated in FIG. 10, to avoid generation of pseudo-edges in moving pictures.

FIG. 10 shows a waveform of the 9-bit video signal for one frame, divided into 22 subfarames per field.

One-frame duration at 16.67 msec gives about 0.76 msec for the average subframe duration P.

The liquid crystal LC may be of any type among VA, HAN, TN, ECB, MTN, SCTN, RTN and HFE modes.

Used in the following disclosure is the AV mode in which negative dielectric anisotropic nematic liquid crystals are vertically oriented.

A pretilt angle and retardation of the liquid crystal LC are 85° and 270 nm, respectively, in the graph shown in FIG. 8. Retardation is given by multiplication of birefringence and cell thickness of the liquid crystal LC.

Plotted on FIG. 8 are the root mean square values of a drive voltage (rectangular waveform) on the axis of abscissas (normalized scale) and modulated brightness (reflectivity) from the liquid crystal LC on the axis of ordinate (normalized scale).

Disclosed below is driving the liquid crystal LC with pulse drive voltages with respect to FIG. 8 in actual application.

The amplitude (voltage) of the first pulse signal is set at the point P0 to gain a contrast ratio of 300:1 for the liquid crystal LC. The amplitude (voltage) of the second pulse signal is set at the point P2 passing the peak voltage P1, to gain enough output light.

These voltage settings are adjusted in accordance with RGB colors.

The first pulse voltages may be 1.65 V, 1.6 V and 1.4 V for R, G and B colors, respectively, and the second pulse voltages may be 5.2 volts, 4.7 volts and 4.4 volts for the R, G and B colors, respectively, when the center wavelengths are 610 nm, 550 nm and 450 nm for the R, G and B colors, respectively.

Figure 12:
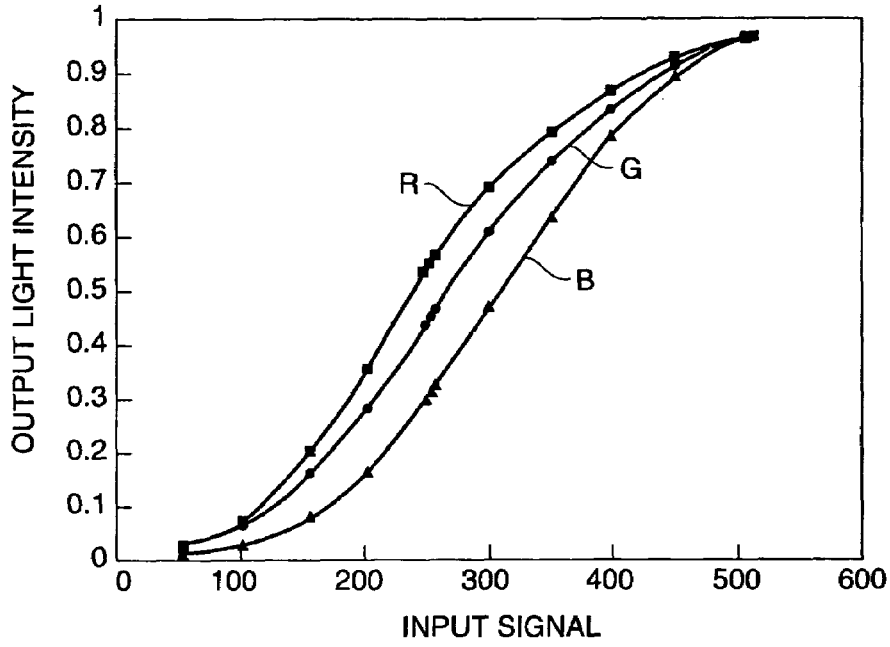
FIG. 12 shows drive characteristics (output light intensity vs. input signal) of a reflective liquid crystal display.

FIG. 12 shows drive characteristics (output light intensity vs. input signal) of a reflective liquid crystal display driven by the first and second pulse signals adjusted as explained above. The reflective liquid crystal display exhibits different drive characteristics over the RGB colors.

Gamma correction different among the RGB colors to these drive characteristics to gain the same drive characteristics can basically prevent color imbalance in accordance with input signals, with a look-up table of gamma-correction coefficients.

Nevertheless, such a look-up table is useless in actual applications due to the following reasons:

The liquid-crystal response speed depends on several factors in liquid crystal, such as, material, orientation, cell thickness, and drive voltage.

Particularly, the liquid-crystal response speed varies in projection liquid-crystal displays due to temperature rise in a liquid-crystal panel when a liquid crystal is exposed to intense light beams.

Temperature rise in a liquid-crystal panel is inevitable for projection liquid-crystal displays although drive voltages are controllable and the material, orientation, and cell thickness can be treated as constant factors once the liquid-crystal panel is produced.

Moreover, pulse-width modulation to drive the liquid-crystal panel causes change in input/output characteristics and also gamma characteristics, which depends on the pulse rise and fall time. The loop-up table explained above cannot offer accurate input/output characteristics.

As already disclosed, one of the features of the present invention to solve such problems is as follows:

An average pulse width P for the first pulse signal (average duration of subframes) is given by $P<0.15\times L$ in which L is a response time L (addition of a rise time and a fall time) of the liquid crystal meet the following requirements:

$$P<L \text{ and}$$

$$P\leqq 0.15\times L$$

Figure 13:
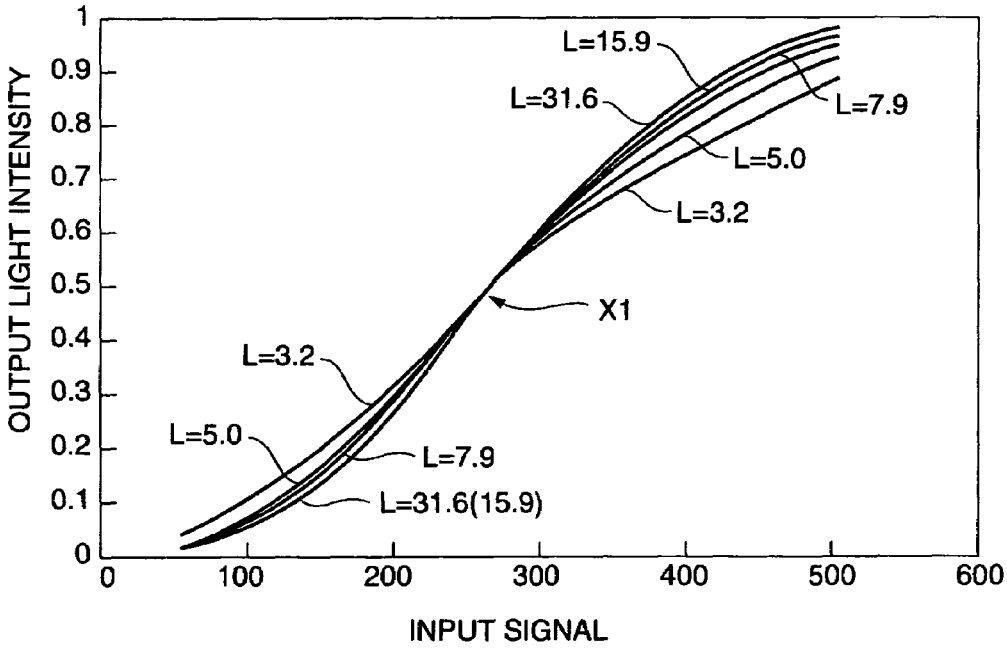
FIG. 13 shows change in drive characteristics of a liquid crystal display against change in response time of a liquid crystal.

Shown in FIG. 13 is change in drive characteristics of a liquid crystal display against change in response time of the liquid crystal.

The response time L (rise time Tr+fall time Td shown in FIG. 11) was varied in the range from 3.2 to 31.6 msec.

FIG. 13 shows that the liquid crystal display has the following tendency:

Increase output light in a dark section (the left side of FIG. 13) when the response time L becomes high (or small) because the liquid crystal exhibits high response in accordance with input pulses; in contrast, decrease output light in a bright section (the right side of FIG. 13) even though the response time L becomes high (or small).

Also shown in FIG. 13 is the opposite tendency as follows:

Decrease output light in the dark section (the left side of FIG. 13) when the response time L becomes low (or large); in contrast, increase output light in the bright section (the right side of FIG. 13) even though the response time L becomes low (or large).

Moreover, FIG. 13 teaches that the output light does not vary at the center section X1 of drive characteristic curves with almost no effects of change in the response time L.

The response time L for acceptable change in drive characteristics is 5.0 msec (critical point) or larger, preferably, 15. 9 msec (critical point) or larger but smaller than 30 msec (which will be discussed later).

When driven by pulse-width modulation, a liquid crystal exhibits excellent drive characteristics as the width of a drive pulse signal becomes smaller in relation to the response time ($P \leqq \alpha \cdot L$ in which $\alpha$ is a coefficient) while the signal is being inverted per subframe.

Substitution of 0.76 msec (discussed with respect to FIG. 10) and 5.0 msec for P and L, respectively, in $P \leqq \alpha \cdot L$ gives $\alpha \leqq 0.15$.

It is therefore understood that meeting the requirement $P \leqq 0.15 \times L$ offers high color reproducibility and also high moving-picture characteristics with almost no effects of temperature change in liquid crystals.

In detail, smaller drive pulse width with the requirement $P \leqq 0.15 \times L$ offers constant gamma characteristics with almost no effects of viscosity of liquid crystals, thus achieving enhanced gradation with no temperature sensors.

The liquid-crystal response time L is preferably shorter than 30 msec, which otherwise causes image persistence, in relation to the moving-picture characteristics.

Substitution of 30 msec for L in $P \leqq 0.15 \times L$, or $0.15 \times 30$, gives 4.5 msec, thus meeting the requirement $P \leqq 0.15 \times L < 4.5$, enhancing the color reproducibility and moving-picture characteristics.

A larger number of subframes require a higher transfer rate for transferring input signals. High transfer rate may be achieved with parallel signal input.

A monocrystal silicon active matrix substrate allows high dense signal output therefrom with easily assembled parallel signal output circuitry, and further allows drive circuitry to be directly built in a liquid-crystal display.

As disclosed in detail, according to the present invention, a liquid-crystal display is driven by pulse-width modulation as follows:

One frame of an input video signal is divided into a plurality of subframes.

A first pulse signal is applied to a liquid crystal irrespective of the level of the input video signal. A pulse width of the first pulse signal corresponds to the duration of each subframe. Application of the first pulse signal only does not drive the liquid crystal.

A second pulse signal is applied to the liquid crystal in accordance with the level of the input video signal so that second pulses of the second pulse signal are superimposed on the first pulses at the same polarity, to perform pulse-width modulation to the liquid crystal.

An average duration P of the subframes and a response time L obtained by adding a rise time and a fall time of the liquid crystal meet the requirements $P < L$ and $P \leqq 0.15 \times L$.

Accordingly, the method of driving a liquid-crystal display with a pulse (digital) drive signal according to the invention achieves displaying images with high color reproducibility and gradation, with simple external circuitry, even when suffering temperature change or noises such as crosstalk.

What is claimed is:

1. A method of driving a liquid-crystal display comprising the steps of:

dividing one frame of an input signal into a plurality of subframes;

applying a first pulse signal to a liquid crystal irrespective of a level of the input video signal, a pulse width of the first pulse signal corresponding to a duration of each subframe, application of the first pulse signal only not driving the liquid crystal;

applying a second pulse signal to the liquid crystal in accordance with the level of the input video signal so that second pulses of the second pulse signal are superimposed on the first pulses at the same polarity, to perform pulse-width modulation to the liquid crystal; and setting an amplitude of the first pulse signal at a threshold voltage just before the liquid crystal is subjected to the pulse-width modulation and an amplitude of the second pulse signal at a voltage between the threshold voltage and a peek voltage at which the liquid crystal produces the maximum brightness or reflectivity;

wherein an average duration P of the subframes and a response time L obtained by adding a rise time and a fall time of the liquid crystal meet the following requirements:

$$P < L \text{ and } P \leqq 0.15 \times L.$$

2. The driving method according to claim 1 further comprising the step of adjusting the first pulse signal so that integration of the first pulses is almost zero in one frame.

3. The driving method according to claim 1, wherein the second-pulse-signal application step comprising the step of performing the pulse-width modulation such that pulses of all of the subframes in one frame are set at a positive or a negative polarity in maximum modulation so that integration of the positive and negative pulses in one frame is zero.

* * * * *